US005219297A

United States Patent [19]

Stein et al.

[11] Patent Number: 5,219,297

[45] Date of Patent: Jun. 15, 1993

[54] SELF-BYPASS TWIN COAXIAL NETWORK CONNECTOR

[76] Inventors: Slav Stein, 20350 W. Country Club Dr., #14, North Miami Beach, Fla. 33180; Chiang Pi-Yu, No. 37, 3rd fl., Pao Shing Rd., Hsien-Tien City, Taipei Hsien, Taiwan

[21] Appl. No.: 893,053

[22] Filed: Jun. 3, 1992

[51] Int. Cl.[5] ..... H01R 29/00

[52] U.S. Cl. ..... 439/188; 200/51.09; 200/51.1; 439/581; 439/620

[58] Field of Search ..... 439/188, 507, 510–512, 439/578, 581; 200/51.09, 51.1

[56] References Cited

U.S. PATENT DOCUMENTS

| | | | |
|---|---|---|---|
| 4,628,159 | 12/1986 | Deitch | 200/51.05 |
| 4,633,048 | 10/1985 | Komatsu | 200/51.1 |
| 4,713,024 | 12/1987 | Hatakeyama et al. | 439/581 |
| 4,759,729 | 7/1988 | Kemppainen | 439/580 |
| 4,786,258 | 11/1988 | Shaffer | 439/188 |
| 4,798,542 | 1/1989 | Asick | 439/188 |
| 4,971,569 | 11/1990 | Gooch | 439/188 |
| 5,078,623 | 1/1992 | Wang | 439/620 |
| 5,145,416 | 9/1992 | Cruise et al. | 439/188 |
| 5,169,343 | 12/1992 | Andrews | 439/581 |

*Primary Examiner*—Paula A. Bradley
*Attorney, Agent, or Firm*—Alvin S. Blum

[57] ABSTRACT

A paired coaxial jack assembly is provided for tap connection in a coaxial-cable network. When a device such as a computer or terminal is connected by paired cables with plugs into the jack assembly, a continuous electrical path is established through the device. When one or both plugs are uncoupled from the jack assembly a shunt or bypass is automatically established between the central conductors of the unmated jacks through a unique switching structure in the jack to maintain undisturbed continuity in the network. The switching mechanism employs a resilient movable contact member held in place by the insulator of the jack. The contact member has a flexible crook or bight that extends into the recess normally occupied by the dielectric of the mating plug. The crook includes a lever arm with a contact end that is normally biased into contact with the central conductor. When a plug is coupled to the jack, its dielectric forces the bight centripetally against a fulcrum portion of the jack's insulator, the lever arm pivots about the fulcrum and the contact end is forced out of contact with the central conductor. The resilient movable contact member of each switching jack is wired to the central conductor of the other jack so that when either switching jack is unmated, the two conductors are connected in a bypass configuration. In another embodiment the switching jack mechanism is used in a self-terminating coaxial connector with the resilient movable contact member wired through a resistor to the outer shielding of the connector to provide a fixed impedance across the cable when the jack is unmated.

8 Claims, 3 Drawing Sheets

FIG. 1
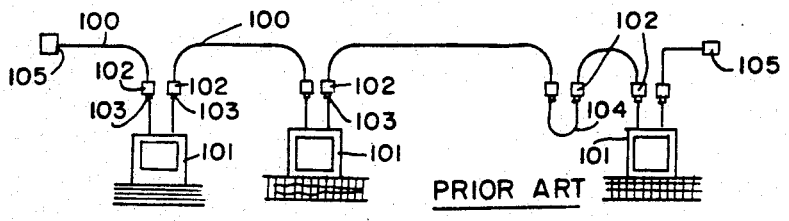
FIG. 2
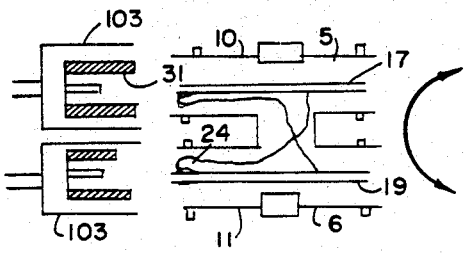
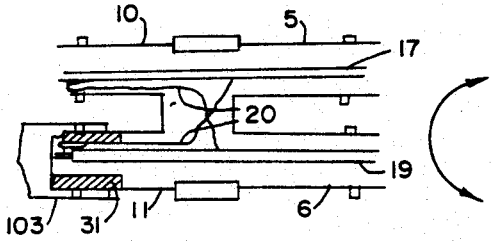
FIG. 3
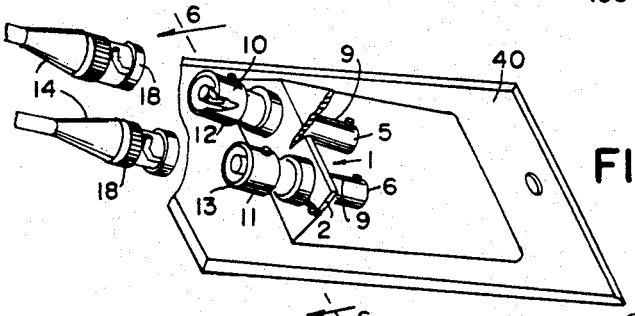
FIG. 4
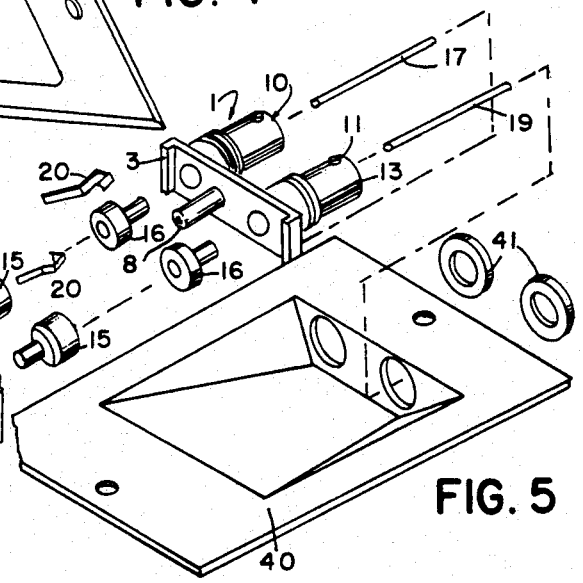
FIG. 5
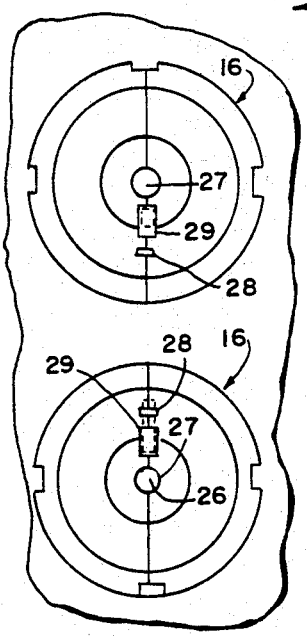
FIG. 9

FIG. 6
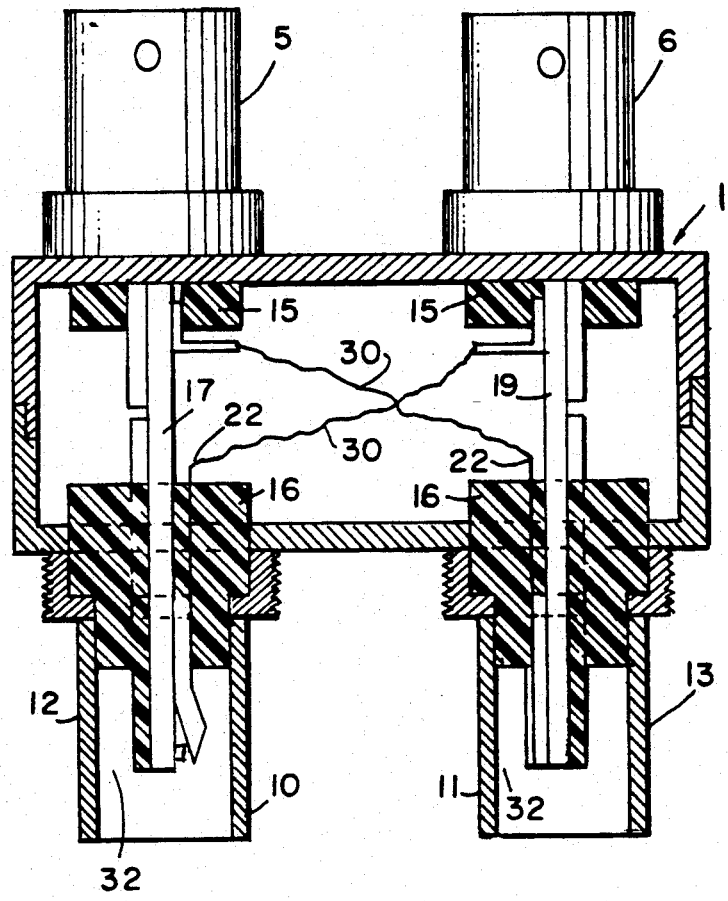
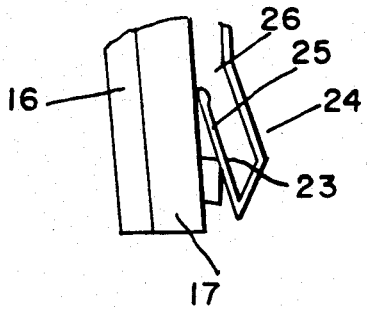
FIG. 6a
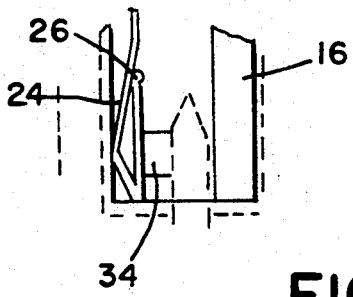
FIG. 6b

FIG. 7
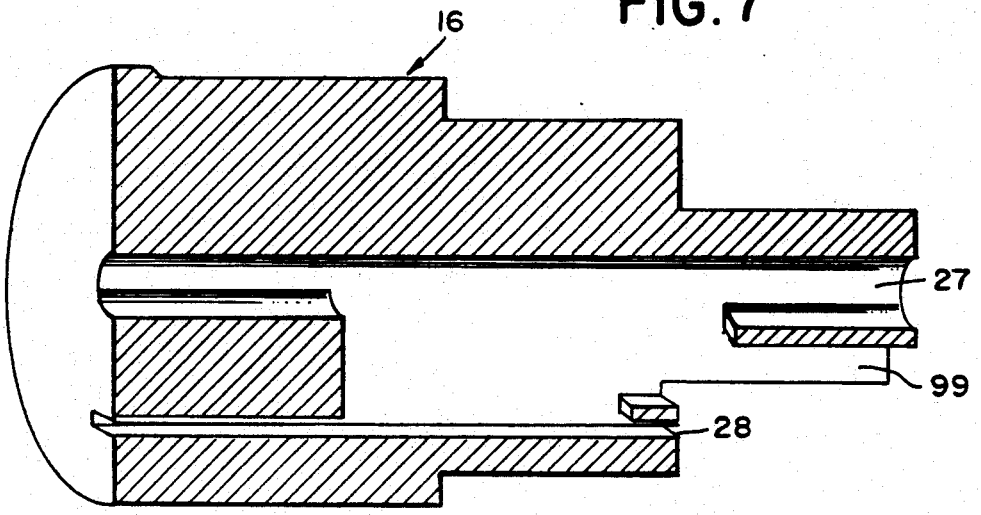
FIG. 8
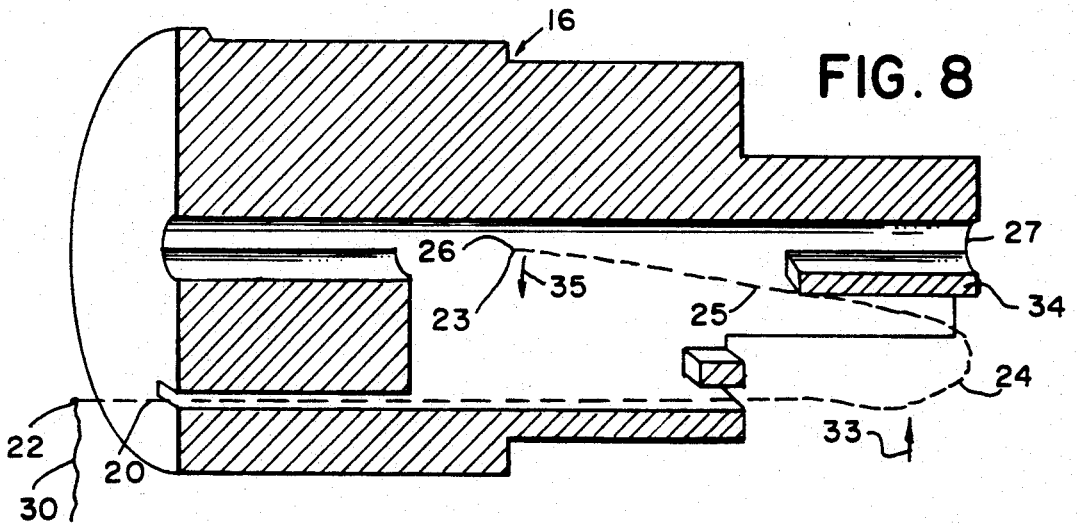
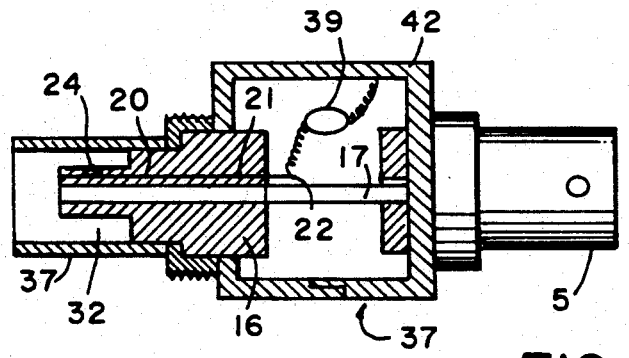
FIG. 10

SELF-BYPASS TWIN COAXIAL NETWORK CONNECTOR

BACKGROUND OF THE INVENTION

This invention is directed to the field of data communication networks using coaxial cables and more particularly to connectors for mounting in a computer network for tap connection of computers and terminals that maintains series connection continuity within the network when mated with a pair of conventional connectors and also when unmated.

FIG. 1 illustrates a known type of data communication network using coaxial cables and connectors. Coaxial cable segments 100 form a backbone which is tapped to connect to computers or peripheral stations or terminals 101. Connections are made by coupling cable connectors 102 to matching device connectors 103. Cable connectors 102 can be BNC style jacks, while matching device connectors 103 can be BNC style plug connectors. This network configuration is popularly referred to as a "daisy chain".

When a device 101 is not connected to a tap connection, a shorting cable 104 must be installed in its place or the entire network will be disabled because the series connection is broken. The network is also disabled while connecting or disconnecting a device 101.

It would be useful to be able to dispense with the shorting cable requirement. It would be useful if a connector could be provided that would maintain series continuity in the network while connecting and disconnecting a device at a tap connector. Because of the investment already made in device cables with conventional connectors, it would be useful if a self-bypass tap connector could be used with conventional cable connectors.

SUMMARY OF THE INVENTION

It is accordingly an object of the invention to provide a new paired jack assembly that can be used with conventional coaxial plug connectors in a series network to provide a tap connection. It is another object that the connectors maintain a shunt or continuity between the conductors of both members of the paired jacks until both members of the paired jacks have been mated with plugs so that no shorting cable is required when a tap connection is unused and no interruption of continuity of the network is caused by connection or disconnection of a device in the network.

The paired jack tap connector assembly of the invention comprises a metal body supporting two conventional coaxial jack connectors such as the BNC style and two special coaxial jack connectors, all four connectors having their metal shields joined to the metal body. The two conventional jack connectors are for connection to BNC plug connectors on cable segments of the network. When thus connected, the cable segments are electrically joined together through a movable contact within each special jack connector. When a terminal is installed at the tap connector by inserting a conventional plug of a cable connected to the terminal into each of the special jacks, each moving contact is moved out of contact. Only when both plugs are mated in the special jacks is the direct short between the network cable segments disconnected and continuity established through the terminal.

The central conductor of each of the conventional jacks is connected to the central conductor of one of the special jacks and also to the moving contact in the other jack. The moving contact temporarily contacts the central conductor in the special jack until moved out of contact by insertion of a mating plug.

Conventional plug connectors have a tubular insulator that surrounds the central insulator of the jack when mounted thereon. The spring contact acts as a lever that is contacting the central conductor at a free end of the lever within the jack.

The lever is forced out of contact by camming action of the tubular insulator of the plug during the mating process. The tubular insulator forces one end of the spring contact toward the conductor and the free end of the lever is forced away from contact with the central conductor, with a portion of the jack's insulator acting as a fulcrum of the lever.

The unique structure for breaking the contact with the central conductor by forcing the moving contact centripetally with the insulator of the mating plug has other functions in coaxial connector art. Connections to coaxial cables must be carefully controlled to prevent disturbances in the characteristic impedance, which can cause signal loss and reflections which disturb operation. It is often necessary to terminate any open connector such as an uncoupled coaxial cable connector by a terminator 105 of FIG. 1 which is matched to the characteristic impedance of the cable. This may take the form of a resistor connected between central conductor and surrounding shield, such as a 50 ohm resistor for RG58 cable.

In another embodiment of the jack of the invention a resistor is connected between the shield and moving contact. When the jack is unmated, the resistor connects the central conductor to the shield, thereby providing automatic self-termination. And when a plug is mated to the jack, the annular insulator of the plug forces the moving contact off the central conductor, as described above, to disconnect the resistor.

These and other objects, features and advantages of the invention will become more apparent when the detailed description is studied in conjunction with the drawings, in which:

BRIEF DESCRIPTION OF THE DRAWINGS

FIG. 1 is a diagram of a network of the prior art.

FIG. 2 is a diagrammatic representation of a connector assembly of the invention.

FIG. 3 is a diagrammatic representation as in FIG. 2 with one plug connected.

FIG. 4 is a perspective view of the connector assembly of the invention mounted on a wall plate with portions broken away.

FIG. 5 is an exploded view from the underside of the assembly of FIG. 4.

FIG. 6 is a sectional view, taken through line 6—6 of FIG. 4, with wall plate removed.

FIG. 6*a* is a detail view of a portion of FIG. 6, unmated.

FIG. 6*b* is a detail view of a portion of FIG. 6, mated.

FIG. 7 is a detailed perspective view of an insulator of a switching jack of FIG. 5, partially cut away.

FIG. 8 is a view of the insulator in FIG. 7, with movable conductor in place.

FIG. 9 is a front elevation view of the insulators of FIG. 7.

FIG. 10 is a sectional view of another embodiment of the jack connector of the invention for self terminating.

DETAILED DESCRIPTION OF PREFERRED EMBODIMENTS

Referring now first to FIGS. 4, 5, 6, a paired jack assembly 1 is secured to a wall mounting plate 40 by threaded nuts 41. The plate is arranged to lie flat against a wall with network cable plugs within the wall being connected to conventional jacks 5 and 6. Extending out from the wall at a downward sloping angle to reduce strain on connecting cables are paired switching jacks 10 and 11. These are arranged for mating with conventional coaxial plug connectors 14 that are coupled to computers, terminals, and the like. The metal housing 2 of the paired jack assembly is formed in two parts, 3 and 4, that join together by a screw in stud 8. Housing part 3 includes a body portion from which extend metal barrels 12 and 13. Housing part 4 includes a body portion from which extend barrels 7 and 9. These barrels are of convention structure for engaging the metal housing 18 of conventional plug connectors. All of the metal barrels are in electrical contact with one another and thus provide continuity with the shielding of the coaxial cables in the usual manner.

Barrel 7 is aligned on a common axis with barrel 12, and barrel 9 is aligned on a common axis with barrel 13. Central tubular conductors 17 and 19 are mounted along the two common axes, with each end of a conductor arranged for receiving the central pin conductor of a mating coaxial plug connector in the usual manner. Insulators 15 hold the central conductors 17 and 19 in position in the conventional jack connectors 5 and 6. Insulators 16 hold central conductors 17 and 19 in position in the switching jack connectors 10 and 11, and they also hold in place the resilient movable contact members 20. Each of these contact members has an intermediate portion 21 joining a fixed connecting end 22 and a movable end 23. The intermediate portion 21 is encased in the insulator 16 which is made in two halves which join together to hold the movable contact member in place. The movable end of the member include a crook or bight 24 that folds back to form a lever 25 that terminates in a contact 26. As best seen in FIGS. 7, 8 and 9, the insulator 16 has an axial channel 27 to secure the central conductor, a first channel 28 to fixedly engage the intermediate portion of the movable contact member and a second channel 29 for free movement of the bight 24. When unmated, the spring tension of the bight 24 forces the contact 26 tightly against the central conductor for good electrical contact. The fixed connecting end 22 of the movable contact member is connected by wire 30 to the other central conductor so that both central conductors are connected together by each movable contact member.

FIGS. 2 and 3 illustrate diagrammatically how a conventional coaxial plug 103, when mated to one of the switching jacks causes the resilient movable contact member 20 to disconnect from the central conductor 19 when the annular dielectric insulator 31 on plug 103 moves into the annular recess 32 formed by the inner wall of the barrel and the outer cylindrical wall of the insulator 16. The insulator 31 forces the bight 24 centripetally (refer to arrow 33, FIG. 8). Fulcrum projection 34 causes lever arm 25 to pivot, and contact point 26 to move centrifugally (arrow 35) and out of contact with the central conductor. Only when both switching jacks or female connectors are mated are the network segments not bypassed. Consequently, there is no interruption of continuity when a terminal is being connected to the network one cable at a time.

The same type of switching jack may also be applied to a self-terminating jack connector 37 as shown in FIG. 10, in which a resistor 39 that matches the cable impedance, such as a fifty ohm resistor for an RG 58 cable is connected between the connecting end 22 of resilient movable contact member 20 and the metallic housing 42 to which the shield of a mating plug is connected. When the jack is unmated, resistor 39 forms an impedance match to a network cable segment connected at conventional jack 5. When a conventional plug connector is mated to jack 37, its annular dielectric insulator occupies the annular recess 32 and disconnects the movable contacts from the central conductor 17 as shown.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

We claim

1. A switching coaxial jack connector for mating with a conventional coaxial plug, the plug being of the type having an annular dielectric and a central conductive pin, said connector comprising:

A) a conductive housing including a body and a barrel extending from the body, the barrel having a forward end for engaging a plug connector and a central axis;

B) a central conductor arranged for receiving and engaging a conductive pin of a plug connector;

C) a central insulator means for holding said central conductor fixedly along said axis within, and insulated from, said barrel, said insulator means having a front end and a back end, said insulator means engaging a portion of the inner wall of said barrel and forming an annular recess extending to the front of the barrel, the recess being defined by the inner wall of the barrel, the outer wall of a portion of the insulator means and a rear wall of the recess formed by a portion of the insulator means, said recess arranged for receiving an annular dielectric of a mating coaxial plug connector; and D) a resilient movable contact member having a fixed intermediate portion joining a fixed connecting end and a movable end, the intermediate portion being fixedly encased by said insulator means with the connecting end extending from the back end of said insulator means and the movable end having a forward bight which extends out of the insulator means and into said recess and terminates within the insulator means at a free end which is spring biased against the central conductor to form a continuous electrical path between the central conductor and the connecting end when said jack is unmated, the forward bight being held away from the central conductor and into said recess by a fulcrum portion of said insulator means, said forward bight occupying space in the annular recess that will be occupied by an annular dielectric of a plug when mated with said jack connector, said bight being arranged to be forced centripetally against said fulcrum portion by an annular dielectric and said free end being arranged to thereby be forced away from, and out of contact with, said central conductor when mated with a plug.

2. The connector according to claim 1, in which said body supports four coaxial connectors, two said switching coaxial jack connectors and two conventional coaxial connectors having central conductors, each switching coaxial connector having a central conductor fixedly connected to a central conductor of one of the conventional connectors and to the connecting end of the movable contact member of the other of the switching jack connectors to thereby form a self-bypass connector in which the central conductors of both conventional connectors are electrically connected unless both switching jack connectors are mated by plug connectors.

3. The connector according to claim 2, in which said conventional connectors supported by said body are jack connectors.

4. The connector according to claim 1, in which said connecting end of said movable contact member is connected through a fixed impedance element to said housing to thereby provide a self-terminating connector with a fixed impedance.

5. The connector according to claim 4, in which said fixed impedance element is a resistor.

6. The connector according to claim 5, in which said resistor has a resistance of substantially fifty ohms.

7. An automatic self-bypassing coaxial connector assembly for conventional coaxial plug connectors, said assembly comprising:

A) a conductive housing including a body having a front face and a rear face, two front barrels extending from the front face, and two rear barrels extending from the rear face, each barrel having a central axis and each barrel on the rear face being coaxial with a barrel on the front face;

B) a pair of central conductors, each one extending axially through the common axis of a front barrel and a rear barrel, each conductor arranged for receiving and engaging a conductive pin of a conventional coaxial plug connector at each end thereof;

C) an insulator within each rear barrel for supporting the central conductor therein and for mating with a conventional coaxial plug connector in a conventional mode of operation;

D) a central insulator means for holding said central conductor fixedly along said axis within each said front barrel and insulated therefrom, said insulator means having a front end and a back end, said insulator means engaging a portion of the inner wall of said barrel and forming an annular recess extending to the front of the barrel, the recess being defined by the inner wall of the barrel, the outer wall of a portion of the insulator means and a rear wall of the recess formed by a portion of the insulator means, said recess arranged for receiving an annular dielectric of a mating coaxial plug connector;

E) a resilient movable contact member having a fixed intermediate portion joining a fixed connecting end and a movable end, the intermediate portion being fixedly encased by said insulator means with the connecting end extending from the back end of said insulator means and the movable end having a forward bight which extends out of the insulator means and into said recess and terminates within the insulator means at a free end which is spring biased against the central conductor to form a continuous electrical path between the central conductor and the connecting end when said jack is unmated, the forward bight being held away from the central conductor and into said recess by a fulcrum portion of said insulator means, said forward bight occupying space in the annular recess that will be occupied by an annular dielectric of a plug when mated with said jack connector, said bight being arranged to be forced centripetally against said fulcrum portion by an annular dielectric and said free end being arranged to thereby be forced away from, and out of contact with, said central conductor when mated with a plug; and F) the connecting end of each movable contact member in a front barrel being electrically connected to the central conductor of the other front barrel to thereby maintain electrical continuity between both central conductors whenever one or both front barrels are unmated with conventional coaxial plug connectors.

8. The connector assembly according to claim 7, in which said insulator means is formed in two halves that join along a plane through the axis of the barrel.

* * * * *